United States Patent [19]

Todaro et al.

[11] Patent Number: 4,906,157

[45] Date of Patent: Mar. 6, 1990

[54] BENDING APPARATUS FOR FLEXIBLE STUDS OF BOOKBINDING STRIPS

[75] Inventors: Frank A. Todaro, Clinton, Conn.; Keith Holmes, Alameda, Calif.

[73] Assignee: VeloBind, Inc., Fremont, Calif.

[21] Appl. No.: 313,248

[22] Filed: Feb. 21, 1989

[51] Int. Cl.[4] ..... B42B 5/14

[52] U.S. Cl. ..... 412/43; 412/7; 412/9; 412/33; 412/38; 281/21.1

[58] Field of Search ..... 412/7, 9, 33, 38, 43; 281/21.1

[56] References Cited

U.S. PATENT DOCUMENTS

| | | | |
|---|---|---|---|
| 3,756,625 | 9/1973 | Abildgaard | 412/43 |
| 3,811,146 | 5/1974 | Abildgaard et al. | 412/43 |
| 4,293,366 | 1/1981 | Szanto | 412/43 |
| 4,369,013 | 1/1983 | Abildgaard | 412/38 |
| 4,656,716 | 4/1987 | Hymmen | 29/270 |
| 4,674,906 | 6/1987 | Abildgaard | 402/80 P |
| 4,685,700 | 8/1987 | Abildgaard | 281/21 R |

*Primary Examiner*—Frank T. Yost
*Assistant Examiner*—Tom Hamill, Jr.
*Attorney, Agent, or Firm*—Julian Caplan

[57] ABSTRACT

One type of bookbinding strip consists of a male strip with plural flexible studs projecting therefrom and a female strip with complementary holes and grooves in the outer surface thereof extending from each hole. The studs are inserted through holes in the punched paper, then through the holes in the female strip. The present invention compresses the strips toward each other with the paper therebetween and then, upon manual actuation of a lever, causes blocks carrying rollers to bend 90° the portion of the studs projecting beyond the female strip, causing these portions to snap into the grooves. Since the grooves on each end of the strip extend toward the middle of the strip, two blocks are used, each moving inward toward the center upon actuation of the lever.

11 Claims, 3 Drawing Sheets

BENDING APPARATUS FOR FLEXIBLE STUDS OF BOOKBINDING STRIPS

BACKGROUND OF THE INVENTION

1. Field of the Invention

This invention relates to a new and improved bending apparatus for flexible studs of bookbinding strips. More particularly, the invention relates to a manually operated machine used to bind reusable flexible binding strips of the type wherein flexible plastic studs project from one strip, fit through holes punched in a stack of sheets to be bound and then through holes in a second strip. The apparatus bends over the length of studs projecting beyond the second strip, forcing the bent-over portions of the studs into grooves formed in the outside surface of the second strip.

2. Description of Related Art

The apparatus hereinafter described is used to bend over bookbinding strips having flexible studs of the types illustrated and described in U.S. Pat. Nos. 4,674,906 and 4,685,700. Heretofore, the studs have been bent over, using the fingers or a hand tool such as shown in U.S. Pat. No. 4,656,716. With the increasing commercial use of such strips, the need has arisen for apparatus for bending the studs mechanically. The present invention satisfies that need.

SUMMARY OF THE INVENTION

The studs of the male strip shown in U.S. Pat. Nos. 4,674,906 and 4,685,700 are passed through punched holes in the sheets to be bound and then through the holes in the female strip. The apparatus provides a horizontal platen which supports the sheets, the studs extending downward beyond the rear edge of the platen. Behind the platen is a space for the female strip, the latter being received in the grooves in the blocks hereinafter described.

Preliminary to bending of the studs, a pressure bar is brought down on the upper surface of the male strip and pressure is applied thereto to compress the strips together with the paper therebetween. Such a mechanism is shown in U.S. Pat. No. 4,293,366, particularly FIG. 5.

Mounted on the machine is an inverted T-shaped lever, the uppermost leg serving as a handle to oscillate the lever. Linkage attached to the ends of the opposed arms of the lever are pivotally connected to two pairs of blocks mounted for horizontal movement on transverse rods, the blocks being initially on opposite sides of the machine and caused to slide toward the center. Pins are mounted on the top of each block positioned so that as they slide inward toward the center of the machine, the pins engage the downward projecting studs and cause the studs to bend at a 90-degree angle and the bent ends to snap into grooves formed in the lower surface of the female binding strip.

Other objects of the present invention will become apparent upon reading the following specification and referring to the accompanying drawings in which similar characters of reference represent corresponding parts in each of the several views.

IN THE DRAWINGS

FIG. 2 is a side elevational view thereof, the opposite side being substantially similar.

DESCRIPTION OF PREFERRED EMBODIMENTS

Figure 1:
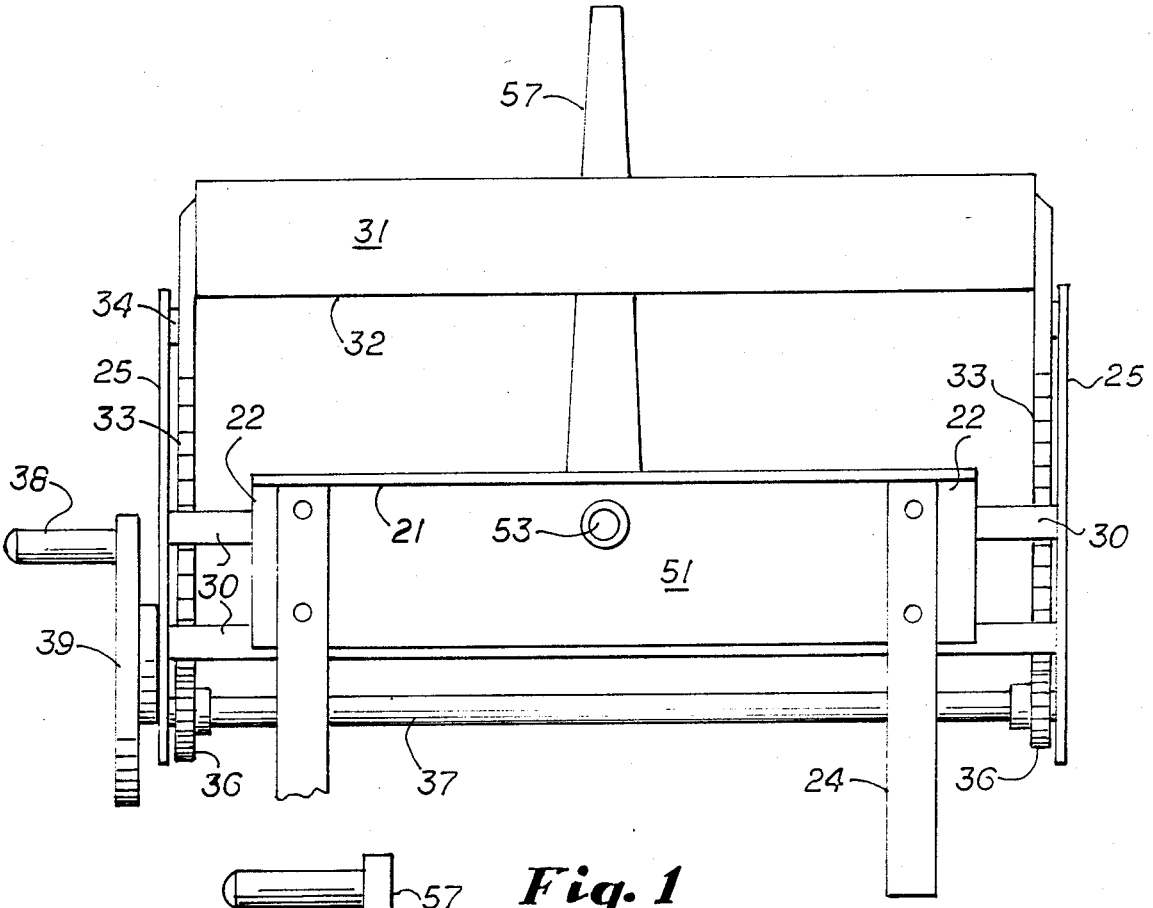
FIG. 1 is a front elevational view of the apparatus.
Figure 2:
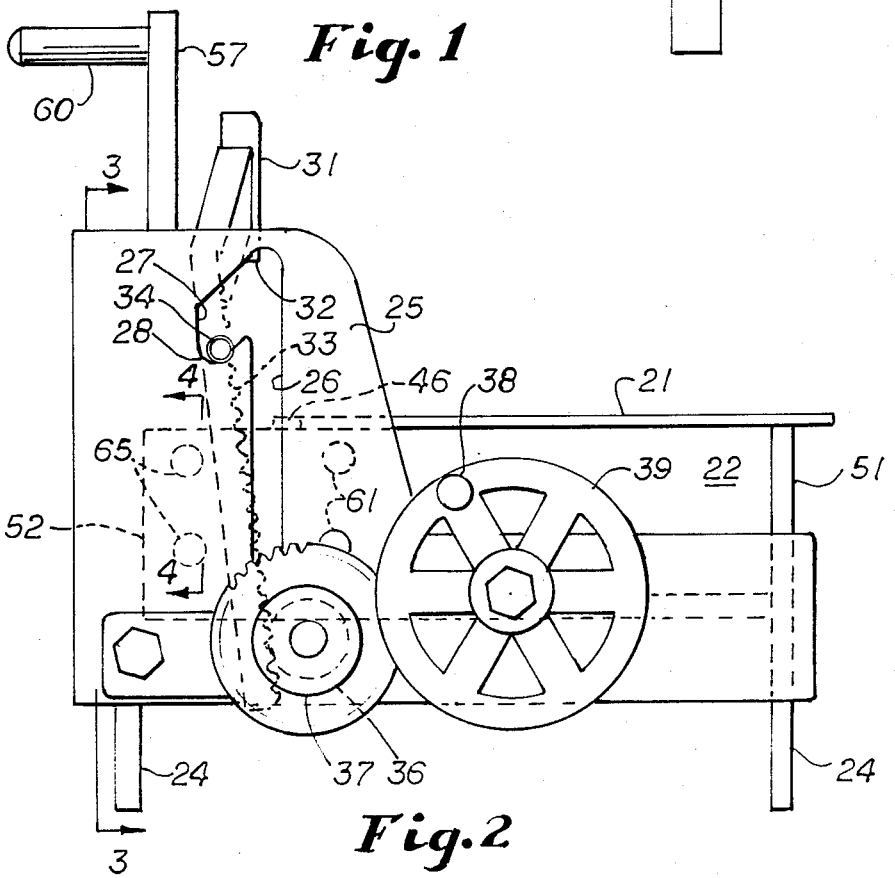

The plastic bookbinding strips used with the present invention comprise a male strip 11 having flexible studs 12 projecting therefrom and a female strip 13 having holes 14 therein spaced at the same intervals as the studs 12, there being on the outside surface of strip 13 a groove 16 extending from each hole 14 inward toward the center of strip 13. Sheets 17 to be bound are formed with holes corresponding to the holes 14. As has been mentioned, such strips are illustrated and described in U.S. Pat. No. 4,674,906, as well as in U.S. Pat. No. 4,685,700.

The machine used to bind a book of the strips and sheets heretofore described has a horizontal platen 21 supported by vertical sides 22 interconnected by horizontal transverse front 51 and back 52 and elevated above the table or other support by legs 24. Outward of sides 22 are outer sides 25. Outer sides 25 are spaced from sides 22 by stand-offs 30 Formed in each outer side 25 is a substantially vertical slot 26 having a rearward/-downward extension 27 at its upper end providing at the bottom of the extension 27 a ledge 28. Transverse pressure bar 31 has a bottom edge 32 which, as hereinafter explained, engages the upper surface of strip 11. On either side of bar 31 are generally vertically extending racks 33. Fixed to each rack 33 is an outward extending roller 34 which rests in the ledge 28 in the upper, or retracted, position of the bar 31. To activate pressure bar 31, the bar is lifted so that the roller 34 is lifted off the ledge 28 and is positioned to move down the vertical slot 26, it being understood that the diameter of roller 34 is approximately equal to the width of the slot 26. Pinions 36 on either side of the machine mesh with the teeth in rack 33 and are interconnected by horizontal transverse shaft 37. Shaft 37 may be turned in various ways, all as is explained in U.S. Pat. No. 4,293,366 and is particularly illustrated in detail therein in FIG. 5. In the present instance a handle 38 may be attached to wheel 39 which is connected through a gear train to pinion 36 meshing with rack 33. Preferably there is a pinion 36 on each side of the machine, mounted on transverse shaft 37.

At the rear of platen 21 is space 46 to receive strip 13. Thus, at commencement of the operation, strips 11 have been assembled with the strips 13 and sheets 17 and inserted in the machine so that the sheets 17 rest on the platen 21, the strip 13 fitting into the space 46 and the studs 12 projecting below the strip 13. Turning pinions 36 causes bottom edge 32 to push against the top surface of strip 11, compressing sheets 17 toward strip 13.

There is a front 51 at the front of sides 22 and a back 52 at the back thereof extending horizontally across the machine. Rotatable in sleeves in the front 51 and back 52 is a longitudinal horizontal shaft 53. Mounted for oscillation on shaft 53 is a vertically transversely disposed inverted T-shaped lever 56 having an elongated handle 57 which may have a hand grip 60 at its upper end and also having oppositely projecting arms 58, 59 at its lower ends, the arms 58, 59 preferably being at right angles to the handle 57.

Figure 3:
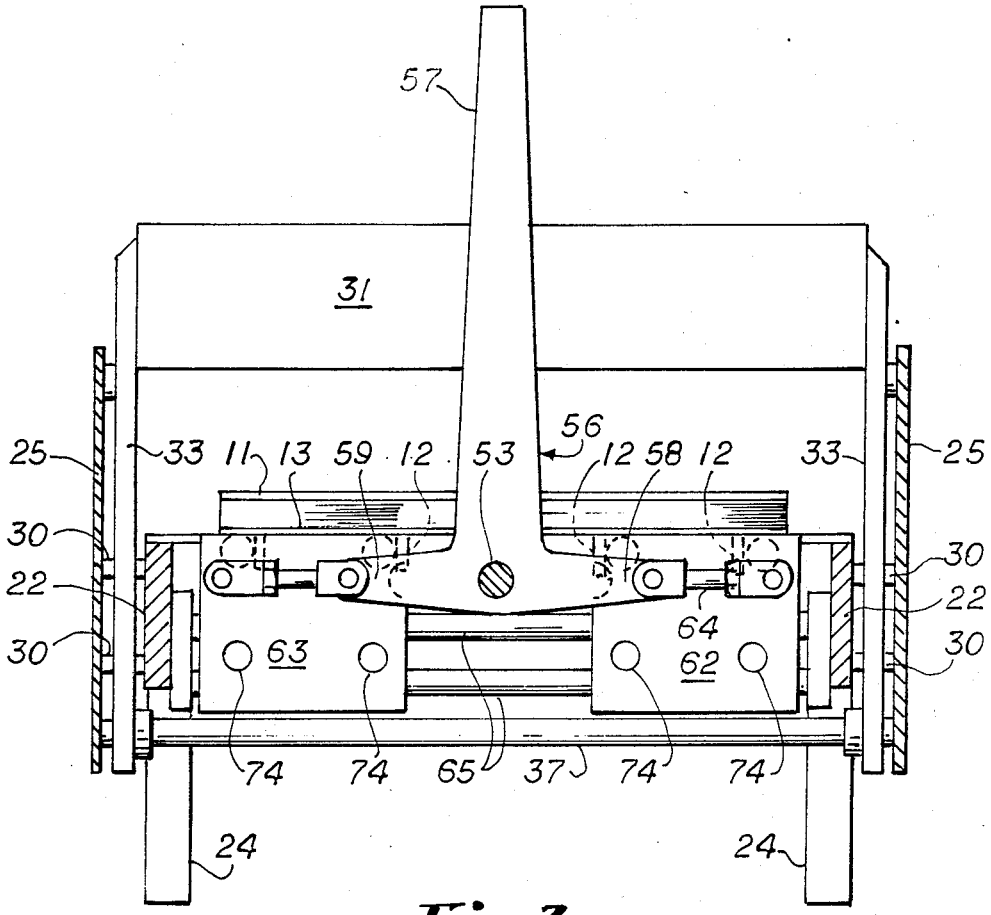
FIG. 3 is a vertical sectional view taken substantially along the line 3—3 of FIG. 2 and constituting in practical effect a rear elevational view, the T-shaped lever being shown in its initial position.
Figure 3A:
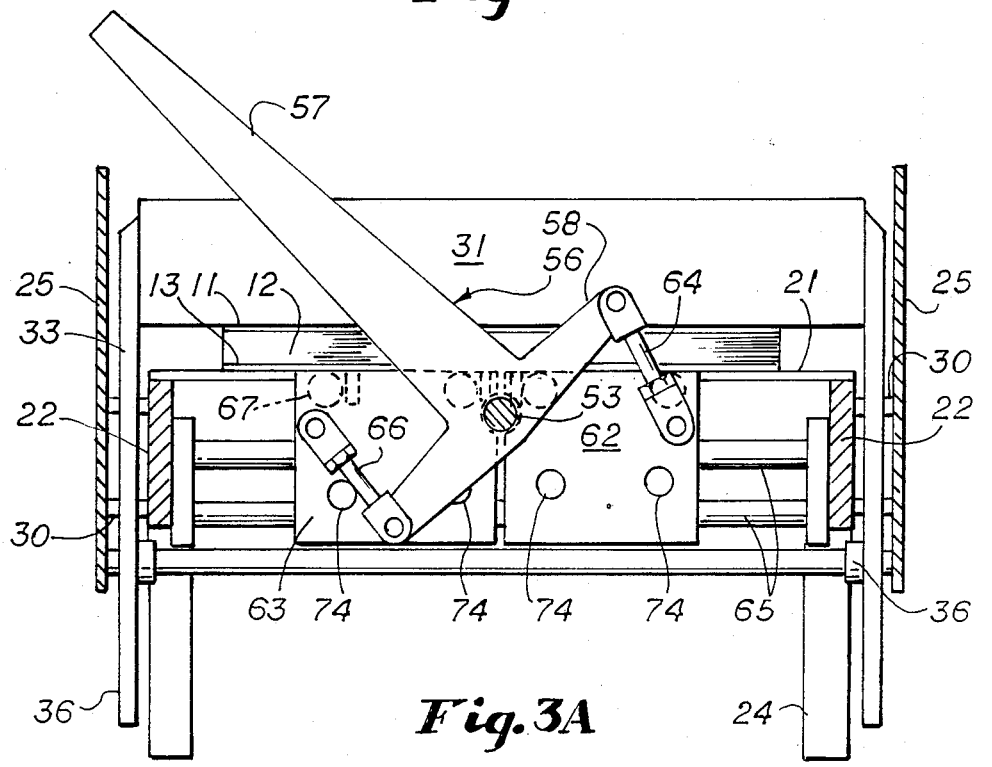
FIG. 3A is a view similar to FIG. 3 showing the lever oscillated to move the blocks inward.
Figure 4:
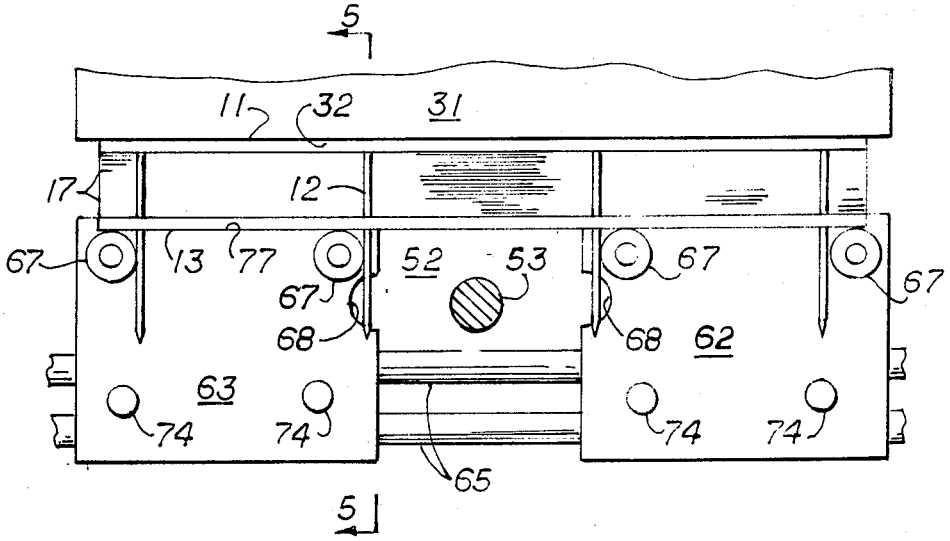
FIG. 4 is a fragmentary enlarged sectional view taken substantially along the line 4—4 of FIG. 2 showing the blocks in retracted position.
Figure 4A:
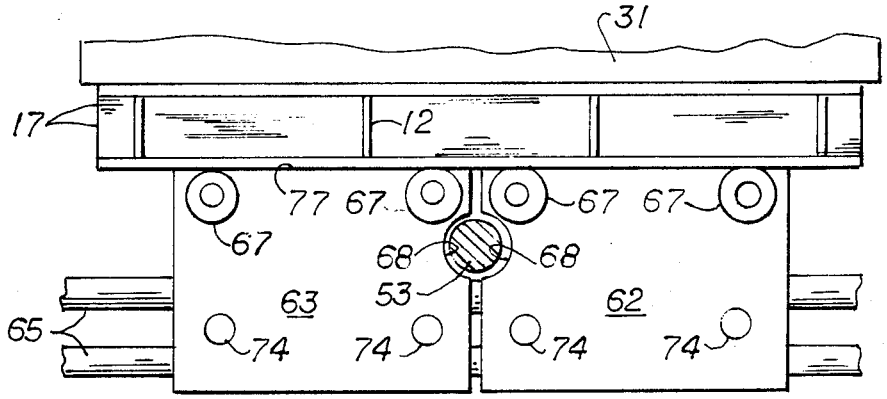
FIG. 4A is a view similar to FIG. 4 showing the blocks in inward position.
Figure 5:
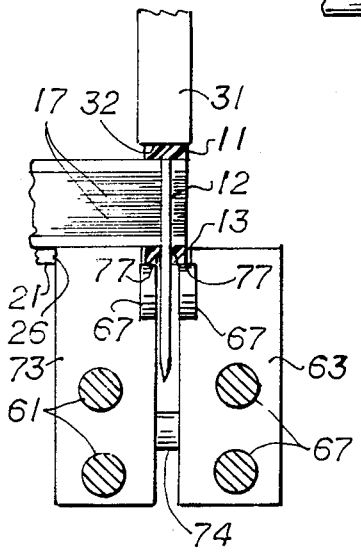
FIG. 5 is a fragmentary sectional view taken substantially along the line 5—5 of FIG. 4.
Figure 6:
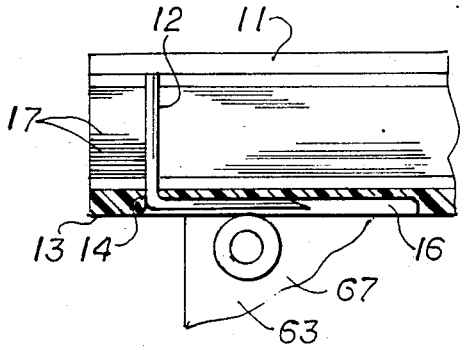
FIG. 6 is a fragmentary sectional view taken substantially along the line 6—6 of FIG. 4A.

Mounted horizontally transversely of the machine are forward rods 61 and rearward rods 65, the rods 61 and 65 being vertically aligned. Slidable transversely of the machine on rods 65 are blocks 62, 63 provided with sleeve bearings (not shown) which slide along the rod 61 with a minimum of friction. Links 64 pivoted to the outer ends of arms 59 are also pivoted to the outer edges of blocks 62, 63. Grooves 68 on the innerfaces of blocks 62, 63 provide clearance for shaft 53. Slidable transversely of the machine on rods 61 are similar blocks, only one said block 73 being shown (FIG. 5). The forward and rearward blocks of each pair are interconnected for movement together by connectors 74, with a space 76 between the interconnected blocks. The upper inner top surfaces of each block are formed with a groove 77. When strip 13 is positioned in space 46, its lower surface fits into and is supported in said grooves 77 while the protruding ends of studs 12 extend into space 76. Mounted on blocks 62, 63 adjacent their upper edges are pins 67. Directing attention now to FIG. 4, it will be seen that the pins 67 are positioned outward of the studs 12 projecting below the female strip 13. When the lever 56 is oscillated to the left, as viewed from the rear (as in FIG. 3A), the arms 58, 59 rock and the links 64 cause the blocks 62, 63, 72, 73 to move from their outward positions to their inward positions and in so doing the pins 67 engage the studs 12 and bend the same down so that they snap into the grooves 16. The sequence of bending is shown by comparison of FIG. 5 with FIG. 6. Thereupon the completed book may be removed by lifting the same from the platen 21.

What is claimed is:

1. A machine for binding flexible studs projecting from a first strip placed on one side of an edge of a stack of perforated sheets wherein said studs pass through perforations in said sheets and through holes in a second strip placed on the side of said stack opposite said first strip comprising support means to support a stack of sheets to be bound with flexible studs projecting from a first strip, through perforations in said sheets and through holes in a second strip, the ends of studs projecting out beyond said second strip, bending means comprising a block and means for moving said block in proximity to said second strip to engage at least one said projecting stud and bend said stud at about a 90° angle to a position parallel to said second strip.

2. A machine according to claim 1 which further comprises compression means to compress said first and second strips toward each other while said stack is disposed in said support means.

3. A machine according to claim 1 in which said means for moving said block comprises guide means for guiding said block in a path parallel to said second strip, a lever and linkage interconnecting said lever and said block whereby moving said lever moves said block.

4. A machine according to claim 3 which further comprises at least one pin mounted on said block, said block having a first position and a second position, said lever moving said block between first and second positions, said pin being on one side of said stud when said block is in first position and moving through and beyond the original position of said stud in travelling to second position, thereby bending said stud.

5. A machine according to claim 3 which further comprises a second block guided by said guide means and second linkage interconnecting said lever and said second block, said blocks having a first position at opposite ends of said second strip and a second position in proximity to the center of said second strip, whereby each said block bends down at least one stud, said studs being bent parallel to each other and in opposite directions.

6. A machine according to claim 5 in which each said block has at least one pin, said pins being on the outside of a stud when said blocks are in first position, whereby as said blocks move toward second position each said pin bends down a stud.

7. A machine according to claim 1 wherein said support means comprises a horizontal platen to support said stack with said projecting studs extending below the level of said platen.

8. A machine according to claim 7 in which said support means further comprises a space behind said platen for said second strip and said blocks are formed with second support means below said space to support said second strip along its length.

9. A machine according to claim 4 in which said means for moving said block comprises a horizontal rod passing through said block parallel to said second strip, a lever pivotally mounted on said machine for oscillatory movement parallel to said rod, said lever having an arm, a link pivoted to said arm and to said block, whereby moving said lever causes movement of said block along said rod parallel to said second strip.

10. A machine according to claim 9 which further comprises a second block movable along said rod, said lever having a second arm opposed to said first-mentioned arm, a second link pivoted to said second arm and to said second block, whereby moving said lever causes movement of both said blocks along said rod.

11. A machine according to claim 10 in which said lever is pivoted to said machine about a horizontal axis transverse to said second strip, whereby said blocks move simultaneously in opposite directions as said lever is pivoted.

* * * * *